United States Patent [19]

Clucker et al.

[11] 3,942,661

[45] Mar. 9, 1976

[54] CONTROL SYSTEM FOR REFUSE HANDLING APPARATUS

[75] Inventors: Richard V. Clucker, Kenton; Roland R. Kennedy, Galion, both of Ohio

[73] Assignee: Harsco Corporation, Camp Hill, Pa.

[22] Filed: Aug. 14, 1974

[21] Appl. No.: 497,247

[52] U.S. Cl. ..... 214/83.3
[51] Int. Cl.[2] ..... B65F 3/00
[58] Field of Search..... 214/83.3, 82, 503

[56] References Cited

UNITED STATES PATENTS

| | | | |
|---|---|---|---|
| 3,092,269 | 6/1963 | Brown et al. | 214/83.3 |
| 3,771,674 | 11/1973 | Clucker | 214/83.3 |
| 3,822,797 | 7/1974 | McKenzie | 214/83.3 |

*Primary Examiner*—Albert J. Makay
*Attorney, Agent, or Firm*—Palmer Fultz

[57] ABSTRACT

A refuse truck of the rear loading type provided with a novel packer blade and associated control apparatus. More specifically, the packer blade is mounted on a carriage that is arranged to reciprocate on an inclined track means so as to load and pack the truck body and the blade and carriage are respectively actuated by separate hydraulic cylinders which are in turn controlled in a novel manner. The control apparatus includes a main power flow circuit for driving the hydraulic cylinders and an associated low pressure fluid signal flow circuit for controlling the flow of oil in the power flow circuit. The signal flow circuit is further characterized by an emergency stop control as well as an optional holding control for certain portions of the cycle of the packer blade.

7 Claims, 13 Drawing Figures

POS 1.
POS 2
FIG. 8-A
FIG. 8-B 100
102
104
106
108
112
114
116
118
119
120
122
124
126
128
130
132
134
136
138
140
142
144
146
148
150
152
154
156
158
159
160
161
162
163
164
165
166
167
168
169
170
171
172
173
174
175
176
177
180
182
184
186
188
190
192
194
196
200
202
204
206
250
262
272
280
290
292
320

NEUTRAL

MAIN SPOOL OUT

MAIN SPOOL IN

CONTROL SYSTEM FOR REFUSE HANDLING APPARATUS

BACKGROUND OF THE INVENTION

Field of the Invention

This invention relates to refuse handling equipment and more particularly to rear load type refuse trucks provided with a novel packing apparatus and associated fluid actuated control system.

SUMMARY OF THE INVENTION

In general the refuse truck of the present invention includes a body comprising a forward refuse receiving body portion and a rear body portion communicating with said forward body portion and provided with a novel packer blade and associated control apparatus.

The packer blade is pivotally mounted on a carriage that is arranged to reciprocate on an inclined track means so as to load and pack the forward body portion and the blade and carriage are respectively actuated by separate hydraulic cylinders which are in turn controlled in a novel manner so as to operate the carriage and the blade through successive cycles.

In accordance with the present invention the above mentioned hydraulic cylinders are driven by pressurized hydraulic fluid from a power flow circuit which is in turn controlled by a signal flow or servo fluid circuit which is preferably operated at lower fluid pressures as compared to the power flow circuit.

As another aspect of the present invention the above mentioned signal flow circuit is provided with an emergency stop apparatus which permits the operator to instantly and positively arrest movement of the packer blade during any portion of the packing cycle.

As another aspect of the present invention, the control circuit is adapted to provide a novel "split cycle" type of operation for the packing blade whereby the circuit automatically arrests the blade prior to its arrival at a pinch point with the bottom of the loading opening.

As another aspect of the present invention, the above mentioned signal flow circuit is provided with a holding circuit for the manual actuator which holding circuit permits manual reactuation of the packer blade after the control circuit has automatically arrested the blade just prior to its arrival at a pinch point of the packer blade with respect to the loading opering thereby completing the cycle of the packing blade.

It is therefore an object of the present invention to provide a novel control system for a refuse packer which includes a main power flow fluid circuit and an associated signal flow circuit with the latter serving to control the former so as to provide novel control functions.

It is another object of the present invention to provide a novel control system for a refuse packer which includes a main power flow fluid circuit and an associated signal flow circuit with the latter being operable at a relatively low pressure as compared to the power flow circuit.

It is another object of the present invention to provide a novel control system for a refuse packer which permits the instantaneous and pressure forced emergency stopping of the packer blade during the portion of the packing cycle.

It is still another object of the present invention to provide a novel control system for a refuse packer which system includes an optional hold-through control feature for manually completing the cycle of operation of the packing blade.

Further objects and advantages of the present invention will be apparent from the following description, reference being had to the accompanying drawings wherein preferred forms of embodiments of the invention are clearly shown.

BRIEF DESCRIPTION OF THE DRAWINGS

FIG. 8-A is a diagrammatic view of a shuttle valve comprising a portion of the control system of FIG. 8;

FIG. 8-B is a second diagrammatic view of a shuttle valve comprising a portion of the control system of FIG. 8;

DESCRIPTION OF THE PREFERRED EMBODIMENTS

Figure 1:
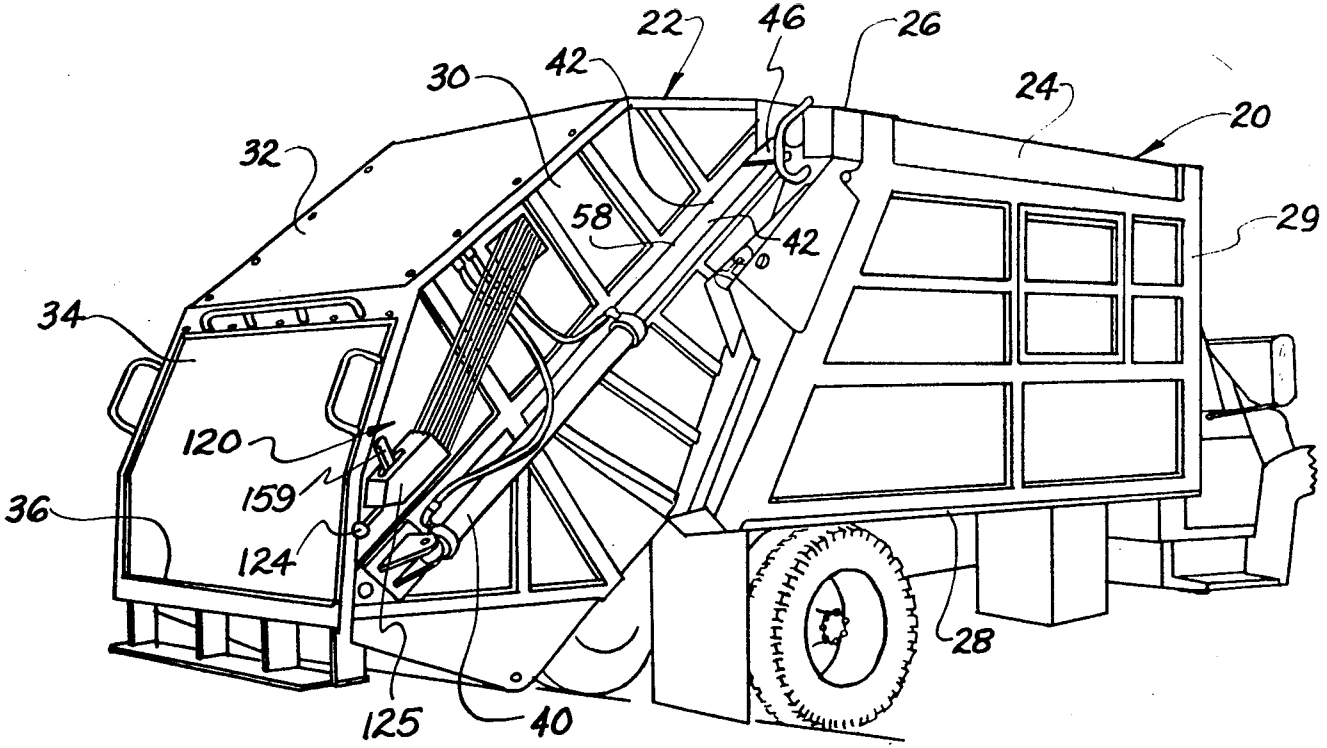
FIG. 1 is a partial rear perspective view illustrating a rear loader type refuse truck to which the apparatus of the present invention has been applied.
Figure 2:
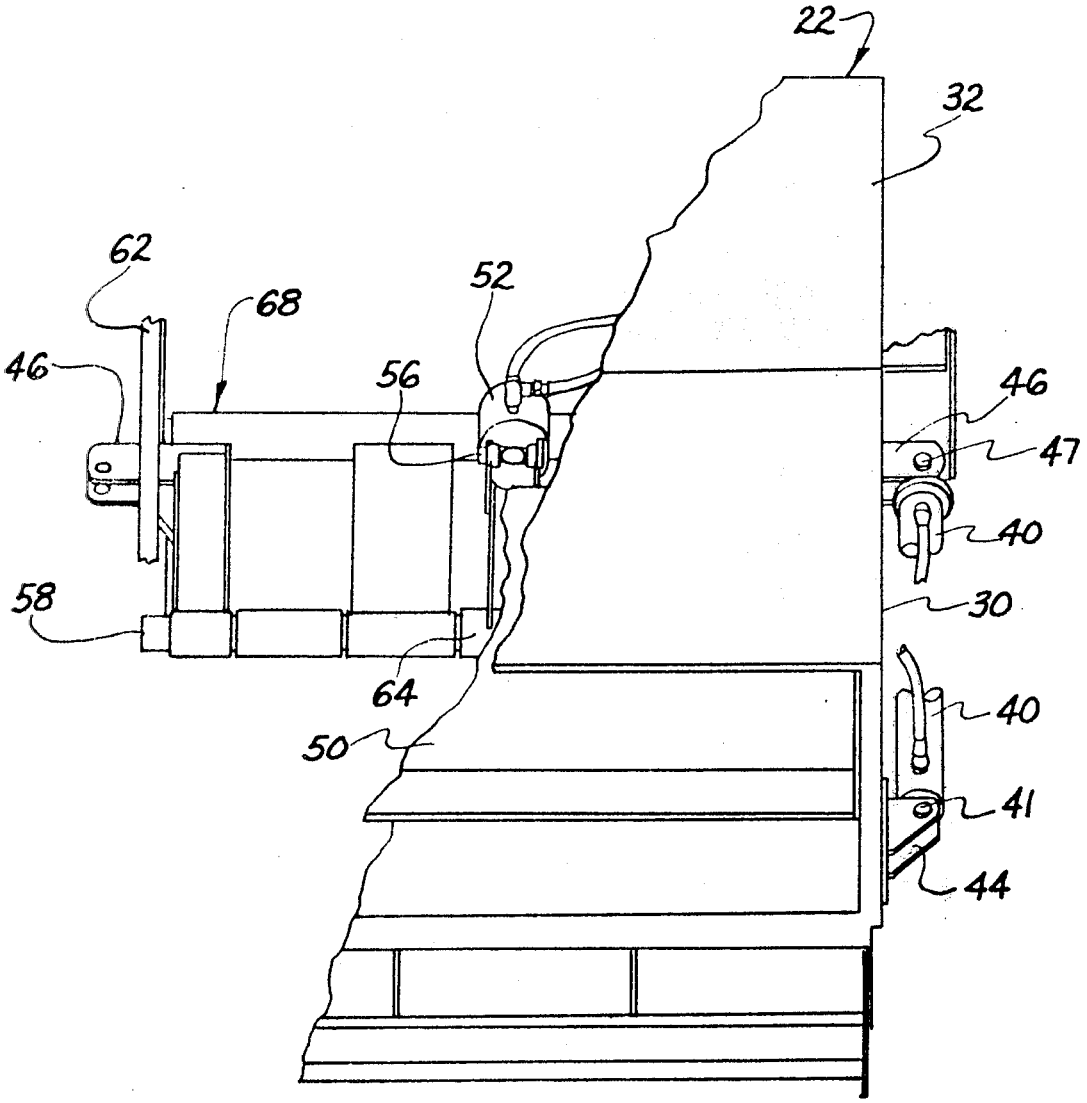
FIG. 2 is a partial rear view, in broken section, showing the packer blade and carriage apparatus comprising a portion of the present invention.

Referring in detail to the drawings, FIGS. 1 and 2 illustrate a rear loader type refuse truck that includes a forward refuse receiving body portion indicated generally at 20 and a rear packer body portion indicated generally at 22. Rear body portion 22 is pivotally attached to the forward body portion 20 at a pivot 48, FIG. 4, and a hydraulic cylinder 21 is operatively connected between the forward and rear body portions at the pivots 23 and 25. Rear body portion 22 can be pivoted upwardly and away from front body portion 20 by extension of hydraulic cylinder 21 thereby permitting unloading of front body portion 20 after it has been packed with refuse.

With continued reference to FIG. 1, forward body portion 20 includes side walls 24, a top wall 26, a bottom wall 28 and a front wall 29 which define a refuse receptacle into which the packing apparatus on the rear body portion 22 functions to load and pack refuse.

Referring next to FIGS. 2 through 6, rear body portion 22 includes a carriage indicated generally at 68 which is mounted for reciprocation on inclined tracks 62 supported by side walls 30 of rear body portion 22.

Carriage 68 includes an upper shaft 60, the ends of which are provided with rollers 66 that run in track 62 and a lower shaft 58, the ends of which are provided with similar rollers 66 which also are mounted in the track.

Carriage 68 further includes outwardly extending brackets 46 which are pivotally attached to a pair of hydraulic carriage actuating or packing cylinders 40 at the pivot pins 47. The lower end of hydraulic cylinders 40 are similarly pivotally attached to the side wall 30 of the rear body portion by the pivot pins 41 in brackets 44. It will now be understood that when carriage actuating cylinders 40 are pressurized in their upper chambers then cylinder rods 42 and carriage 68 are retracted downwardly and, conversely, when the other ends of the cylinders 40 are pressurized the cylinder rods and carriage will be extended upwardly.

With reference to FIGS. 2 through 6, a packing blade 50 includes collars 64 which are pivotally mounted on shaft 58 and a blade actuating cylinder 52 includes an inner end pivotally mounted on carriage 68 at upper shaft 60 and an extendable ram 54, the outer end of which is pivotally connected to packer blade 50 at a pivotal connection 56. It will now be understood that when blade actuating cylinder 52 is pressurized so as to extend ram 54 the packing blade will be pivoted about lower shaft 58 from Position 2 to Position 3. Conversely when the other side of cylinder 52 is pressurized so as to withdraw ram 54, then packer blade 50 will be raised from Position 3 to Position 2.

It should be mentioned that the operators load refuse into the rear body portion 22 via a rear opening 34 such that the refuse is disposed on a bottom wall 36.

In general, when packing blade 50, just described, moves from Position 2 to Position 3 blade 50 will engage the refuse and, during a subsequent cycle, later to be described, when carriage actuating cylinder 40 is extended to raise carriage 68 from Position 3 to Position 4 then the refuse is further moved up into the previously described receptacle formed by forward body portion 20. As the forward body portion becomes filled the carriage actuating cylinders 40 serve to compress and pack the load.

OPERATION OF THE POWER FLOW CIRCUIT

Figure 6:
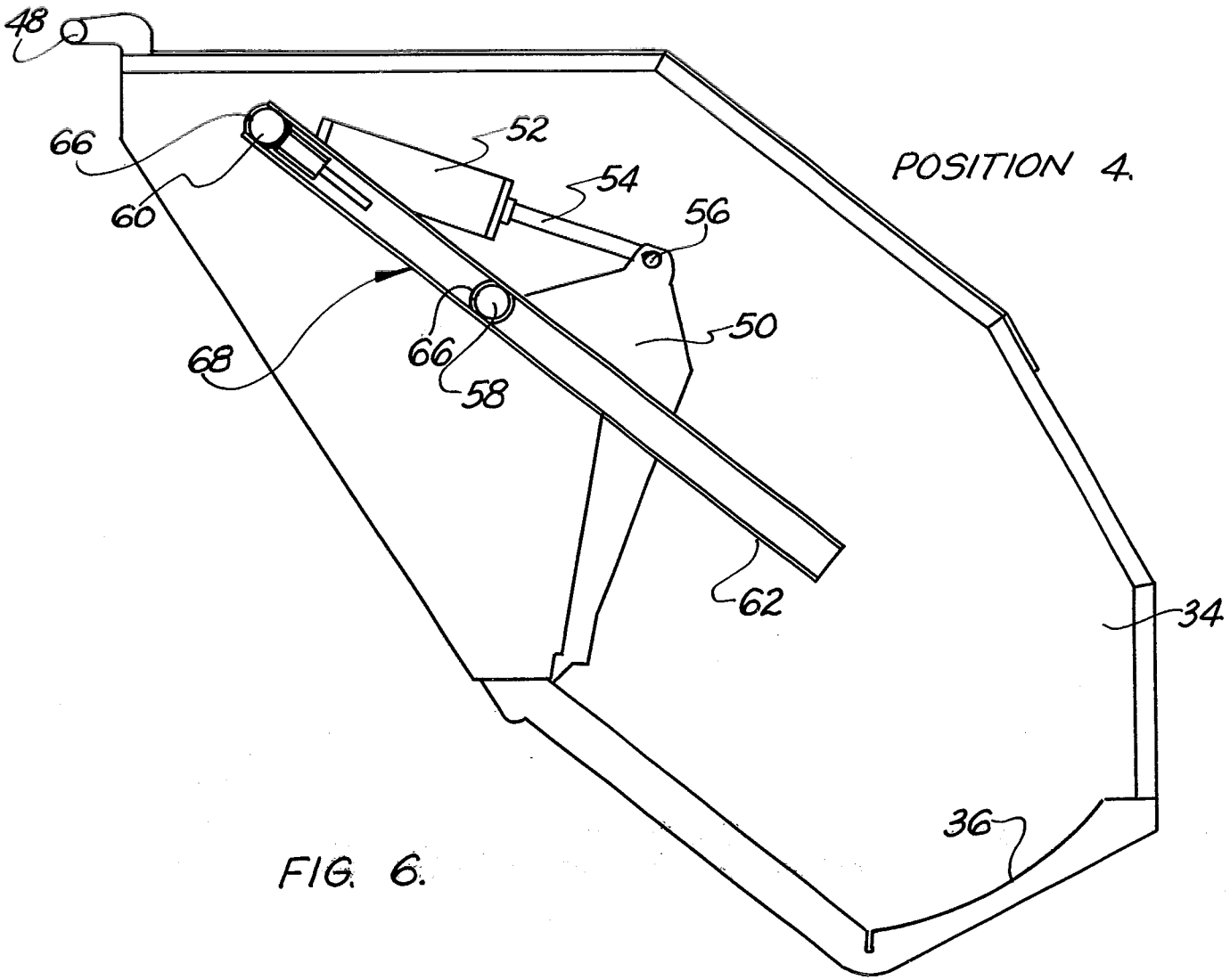
Figure 7:
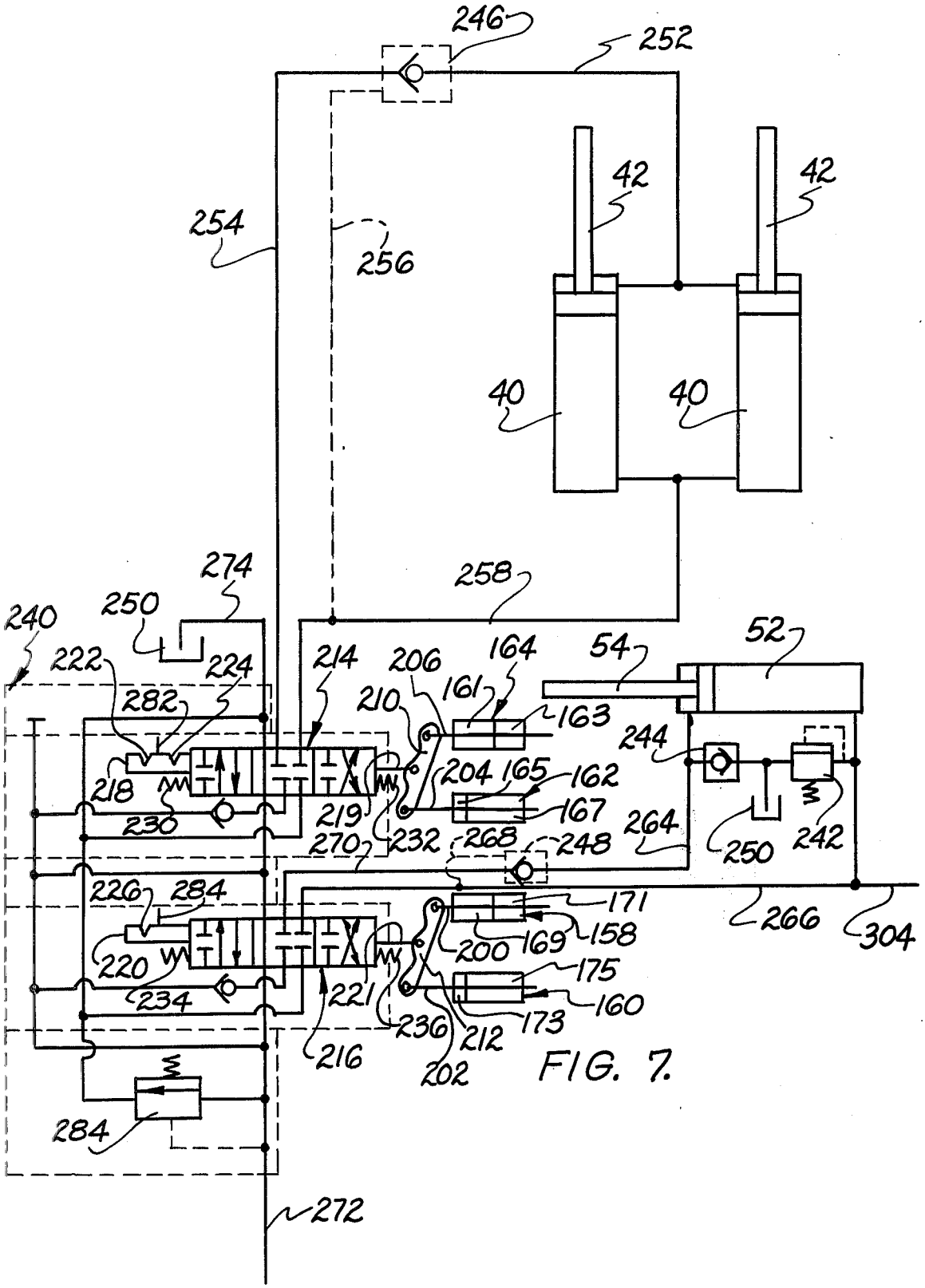
FIG. 7 is a diagrammatic view of the control system for the refuse machine of the preceding figures.

Reference is next to FIG. 7 which illustrates a power flow circuit for supplying pressurized fluid to the previously described packing cylinders 40 and blade actuating cylinder 52. The initial position of the packing mechanism is shown in FIG. 6. During the first phase of the cycle of operation packing blade 50 moves from Position 4, FIG. 6, to Position 1, FIG. 3. At this time a power flow control valve mechanism indicated generally at 240 causes the combined packing blade and carriage mechanism to move from Position 1 to Position 2, FIG. 4, at which point carriage 68 automatically stops.

Figure 4:
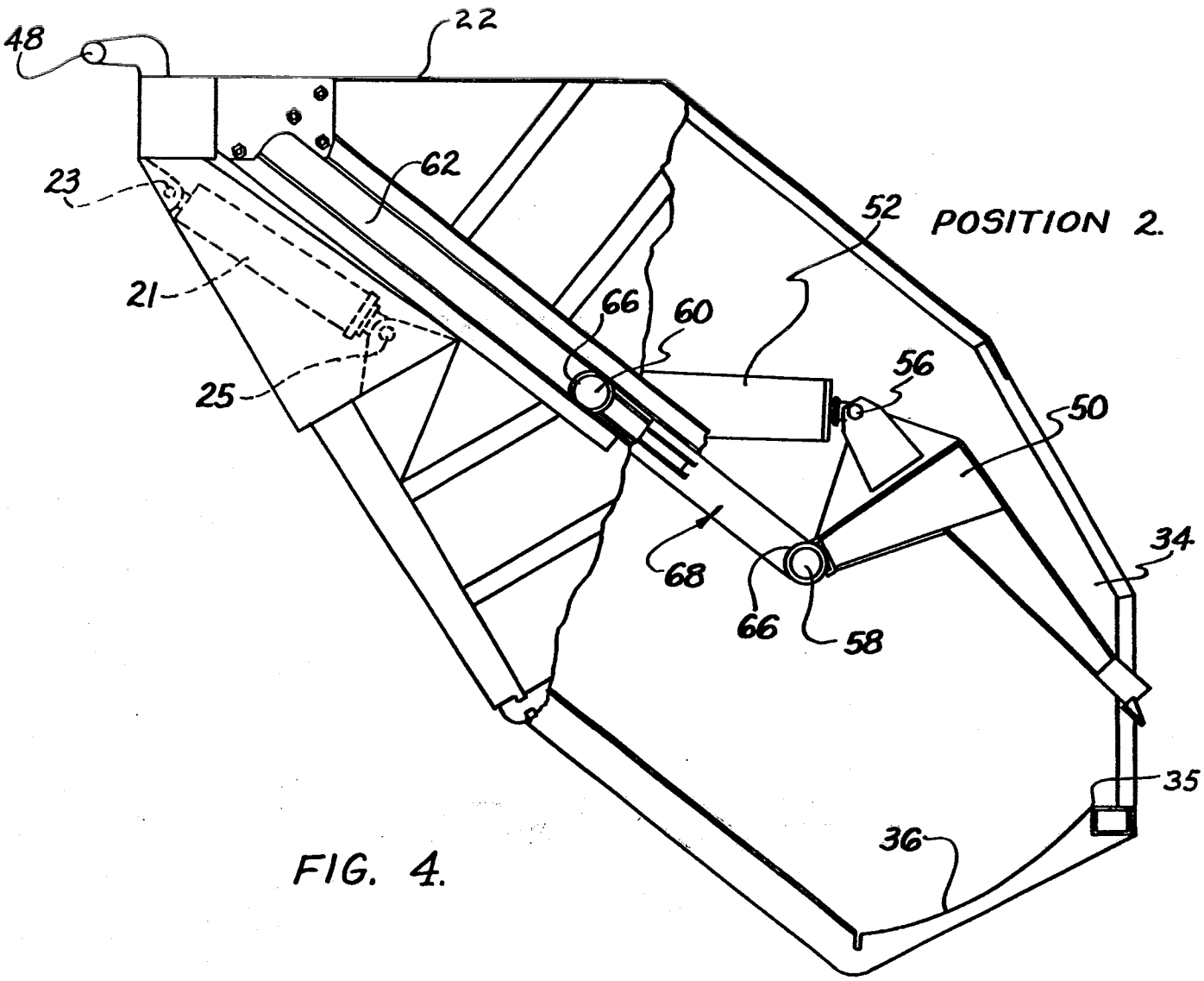
Figure 5:
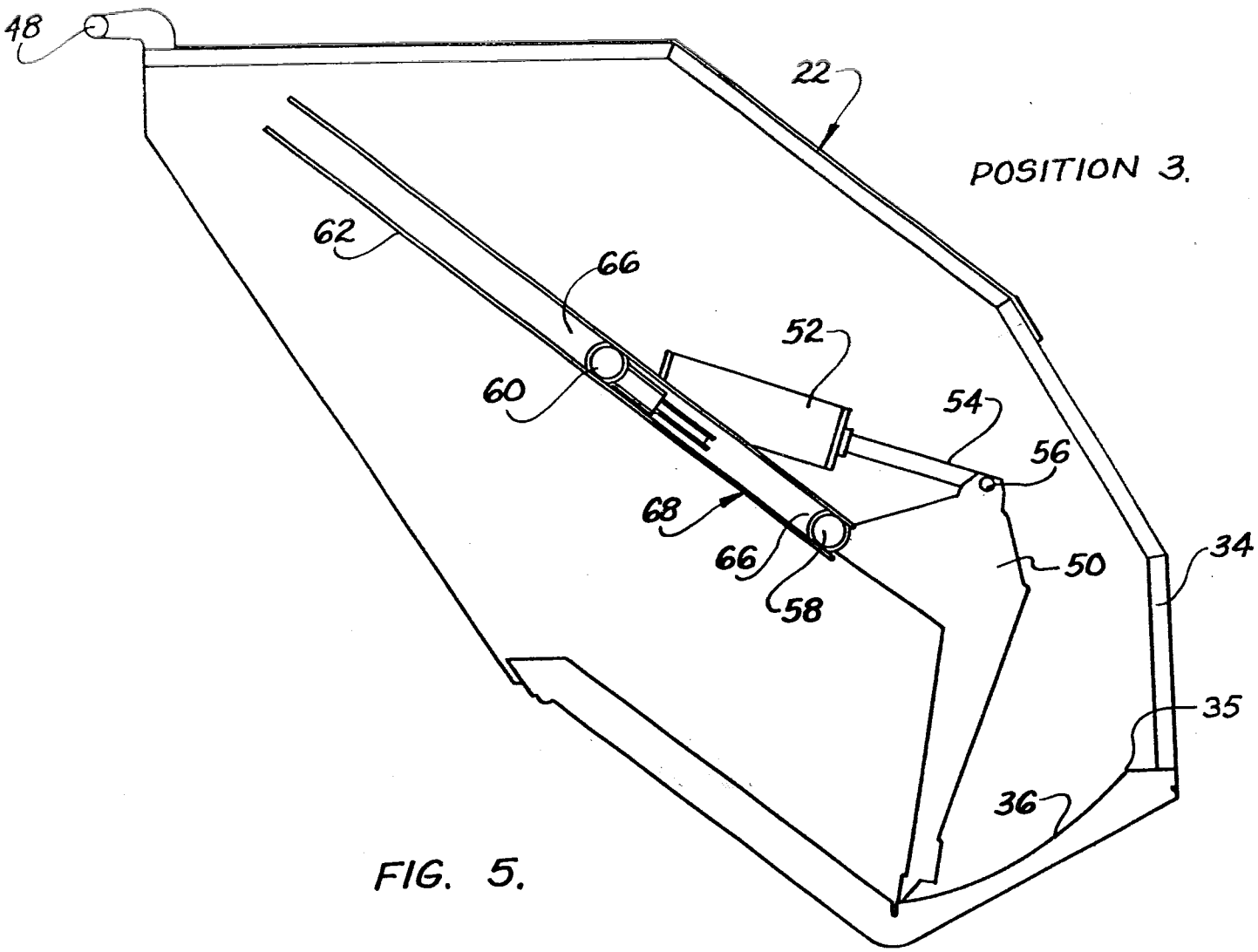

In the second phase of the cycle of operation power flow control valve 240 is again actuated at which time the packing blade 50 will move from Position 2, FIG. 4, to Position 3 FIG. 5. At this time, power flow control valve 240 will automatically shift and the packing mechanism will move up the track 62 from Position 3 to Position 4 at which point it will automatically stop. This last motion is called the packing motion of the machine.

Actuation of power flow control valve 240 is provided by the control flow circuit shown in FIG. 8, which will be described later. In general the control flow circuit provides controlled low pressure flows of pressurized oil from flow divider 100, FIG. 8, for slave cylinders 158, 160, 162, and 164 shown in FIG. 7 which shift spools 214 and 216 that in turn control the power flow.

Power flow control valve 240 consists of two power flow spools 214 and 216, FIG. 7. Control spool 216 is provided with a spool extension 221 on which is pivotally mounted a rocker bar 212 to the ends of which are connected pistons 200 and 202 of slave cylinders 158 and 160, respectively. The other end of power flow spool 216 carries a detent mechanism 220 which includes one detent 226 and a pressure actuated latch 284 which serves to latch spool 216 in its "out" position.

Power flow spool 214 consists of a spool extension 219 connected to a rocker arm 210 which is in turn connected to piston rods 206 and 204 of slave cylinders 164 and 162, respectively. The other end of power flow spool 214 carries detent mechanism 218. This mechanism has two detents, 222 and 224, and a pressure actuated latch serves to hold the spool in either the "out" or the "in" position, depending on how actuated.

In FIG. 7 power flow control valve 240 is of the open center type and is shown in the neutral position. In such position of power flow valve 240 the pressurized oil in line 272 flows directly through the valve to line 274 and returns to tank 250. All cylinder ports are blocked in this position.

Figure 12:
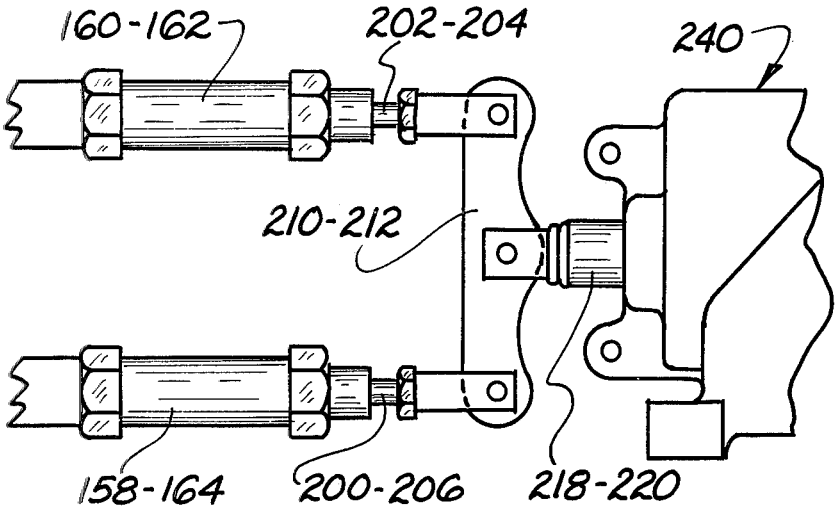

When the packing cycle is initiated by the control flow circuit, by actuating master control valve 150, FIG. 8, as will be described later, pressurized oil is introduced into chambers 161, 165, 169 and 173 of slave cylinders 164, 162, 158, and 160, respectively. This causes piston rods 206, 204, 200 and 202 to move to the right as viewed in FIG. 7, thus extending spools 214 and 216 to their so-called outer position as shown in FIG. 12. Arriving at this position control spools 214 and 216 are locked therein by latches 282 and 284 entering detents 222 and 226, respectively.

Figure 3:
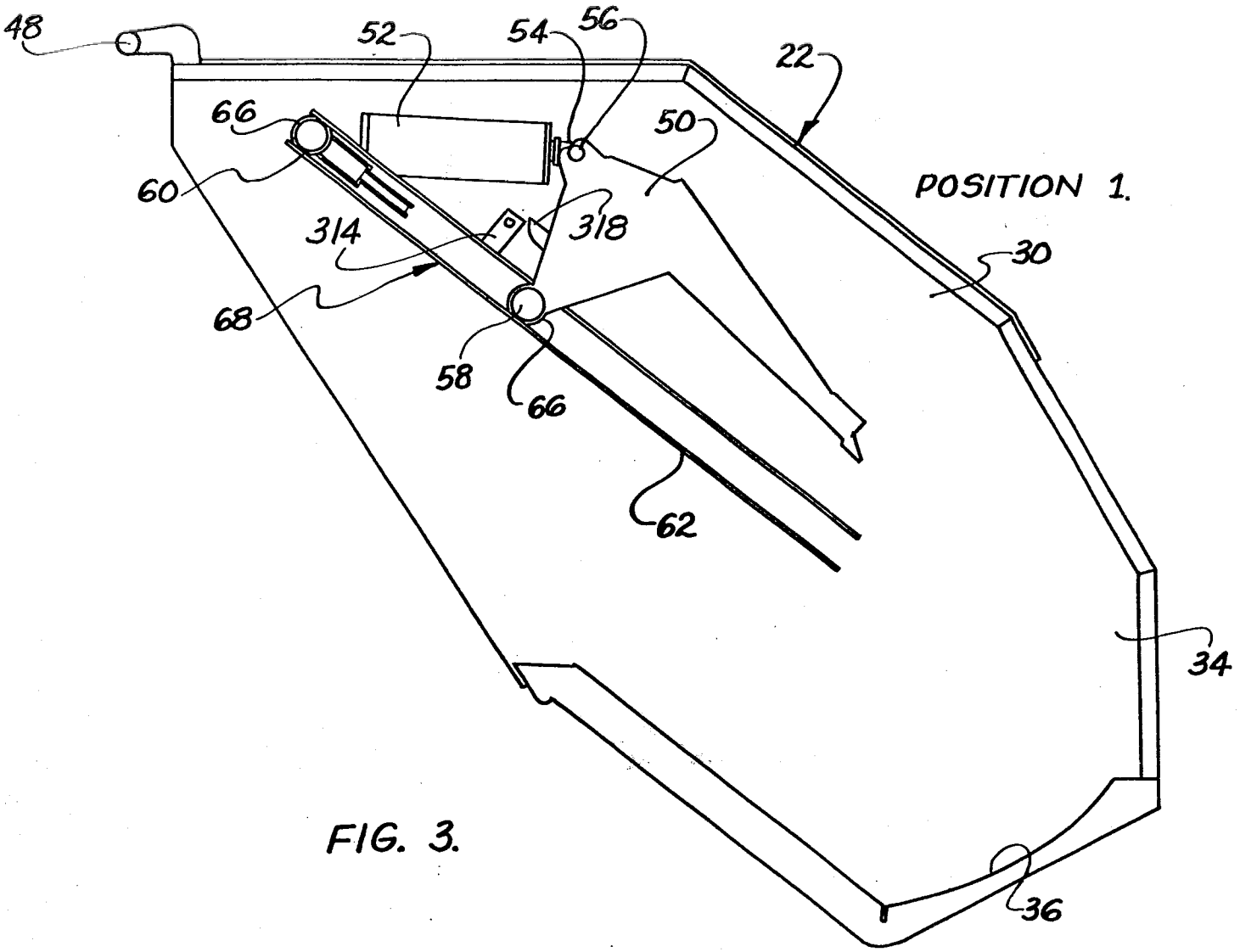
FIGS. 3 through 6 are side sectional views of a rear body portion and apparatus of FIG. 2, the section being taken along a vertical plane through the centerline of such body portion.

With power flow control valve 240 in the outer position the pistons of the slave cylinders are free to move. Oil flows through flow divider 100 and line 272, FIG. 8, and into line 272, FIG. 7. This pressurized oil flows through spool 216 and via line 270 through pilot check valve 248, lines 264 and into the rod side of blade activating cylinder 52. This valve also drains the base side of blade actuating cylinder 52 to tank via lines 266 through spool 216 and line 274 to tank 250. With spools 214 and 216 locked in the "out" position pressure oil is prevented from entering spool 214 by spool 216. Pressurizing the rod side of cylinder 52 causes piston rod 54 to move to the right as shown in FIG. 7. This action in turn causes scoop 50 to move from Position 4 as shown in FIG. 6 to Position 1 as shown in FIG. 3.

When blade 50 arrives at Position 1 oil pressure builds up causing pressure sensing latch 284 to retract thus permitting spool 216 to return to neutral position by the action of centering spring 236. When spool 216 is returned to this neutral position, pressurized oil will flow from line 272 to spool 214 and then via line 254 through pilot check valve 246, line 252 into the rod end of packing cylinder 40. At the same time, the base side of packing cylinders 40 drains through line 258, spool 214 and line 274 back to tank 250.

Introducing pressure oil into the rod end of cylinders 40 causes piston rods 42 to retract. Since these rods are connected to cause 68 this action causes carriage 68 and blade 50 to move from Position 1 as shown in FIG. 3 to Position 2 as shown in FIG. 4. When cylinders 40 are fully retracted oil pressure will again build up causing detent latch 282 to release spool 214 and spool 214 will be returned to neutral position by centering spring 232. This will complete the first half of the cycle since both control valves spools 214 and 216 are in neutral position and pressurized oil from line 272 is flowing directly through power flow control valve 240 to line 274 and thus to tank.

Figure 8:
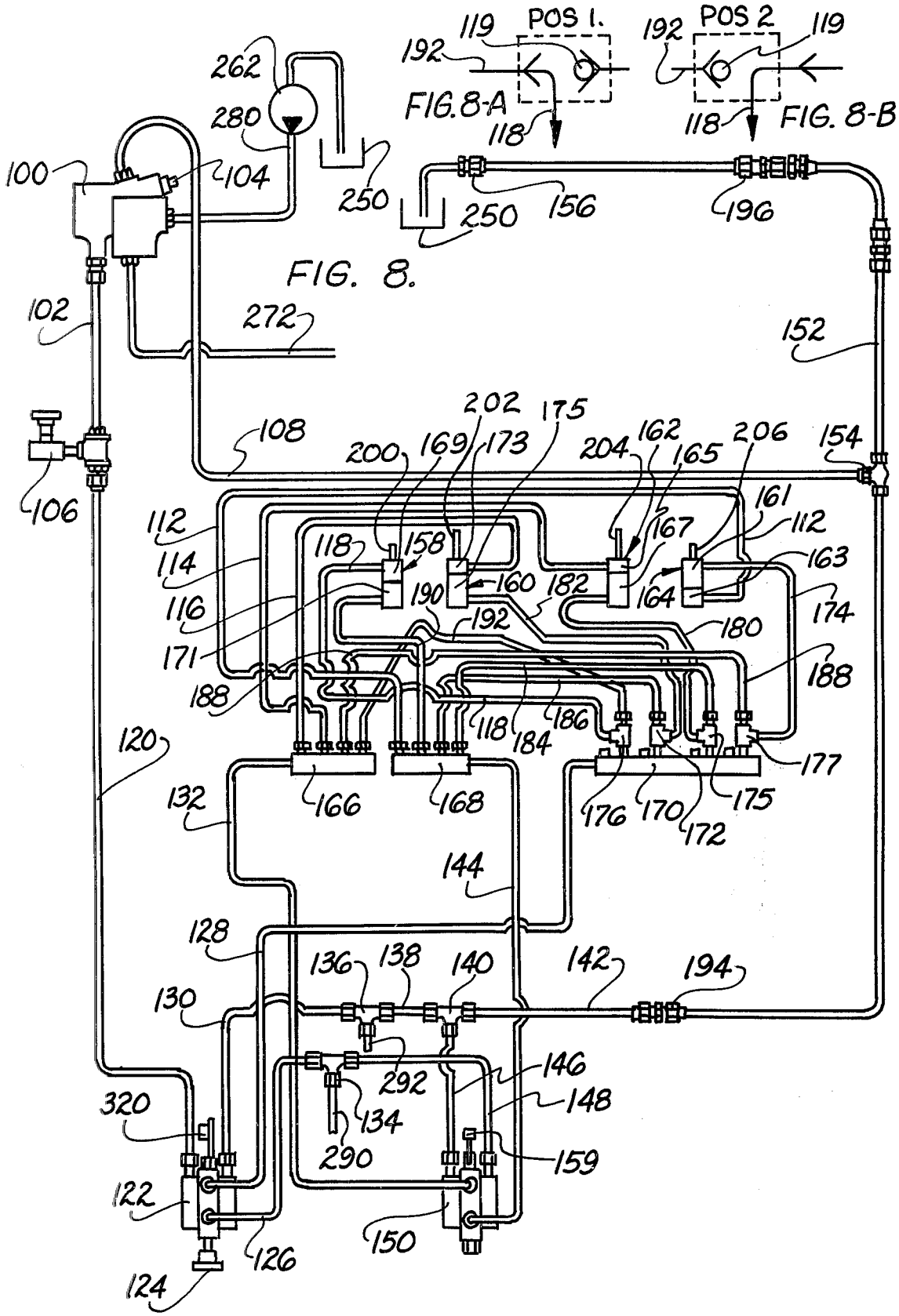
FIG. 8 is a second diagrammatic view of the control system for the refuse machine of the preceding figures.

To initiate the second portion of the packing cycle the control flow circuit must again be activated by actuating master control valve 150, FIG. 8. This pressurizes chamber 163, 167, 171 and 175 of slave cylinders 164, 162, 158 and 160. This causes piston rods 206, 204, 200 and 202 to move to the left as shown in FIG. 7 causing spools 214 and 216 of power flow control valve 240 to move to the "in" position shown in FIG. 13. With spool 216 in the "in" position pressurized oil flows from line 272 through spool 216 and via line 266 to the base end of blade actuating cylinder 52. Pressurized oil from line 266 also flows through pilot line 268 and opens pilot check valve 248 thus permitting oil to drain from the rod end of blade actuating cylinder 52 through line 264, pilot check valve 248, line 270, spool 216 and line 274 to tank 250.

With spool 216 in the "in" position, pressurized oil is blocked by spool 216 from passing on to spool 214, with oil being introduced into the base end of blade actuating cylinder 52 which causes the blade 250 to move from Position 2, FIG. 4, to Position 3, FIG. 5. It must be noted at this time that spool 216 has no detent holding the spool in the "in" position. Spool 216 must be maintained in the "in" position by continued actuation of control flow circuit so that chambers 171 and 175 of slave cylinders 158 and 160 remain pressurized. This is accomplished by the operator actuating master control operating handle 159 of master control valve 150 as shown in FIG. 8.

When blade 50 reaches Position 3 as shown in FIG. 5 the operator may release master control operating handle 159 as shown in FIG. 8. This will permit spool 216, FIG. 7, to return to the neutral position by means of spring 234. Once spool 216 has returned to the neutral position pressure oil will flow through line 272, spool 216 and to spool 214. Since spool 214 is still locked in the "in" position by detent 224 pressurized oil will flow through spool 214 via line 258 to the base end of packing cylinders 40. Pressurized oil will also flow through line 256 thus opening pilot check valve 246 permitting oil to drain from the rod end of packing cylinders 40 through line 252, pilot chedk 246, line 254, spool 214 and into line 274 to tank 250. This action will cause carriage 68 and scoop 50 to move from Position 3 as shown in FIG. 5 to Position 4 shown in FIG. 6.

Once these components have arrived at Position 4 pressure will build up releasing pressure sensing detent 282 which permits spool 214 to return to neutral position. This completes the packing cycle of the machine.

OPERATION OF CONTROL FLOW CIRCUIT

Referring to FIG. 8, pump 262 delivers pressurized oil through line 280 to previously mentioned flow divider 100. As has been mentioned before, this flow divider by-passes the main portion of the oil through line 272 into power flow control valve 240.

The control flow circuit is provided with pressurized oil by flow divider 100 through lines 102, 120, to emergency stop valve 122. With emergency stop valve 122 in the "out" position, with respect to actuator 124, the control flow of oil is provided to master control valve 150 via lines 126 and 148. Master control valve 150 is a standard four-way, spring centered control valve with open center with pressurized oil flowing to tank when the valve is in its neutral position.

When master control operating handle 159 of valve 150 is actuated so that the spool of master control valve 150 is extended to its out position a relatively low pressure control flow of oil flows through line 132 to manifold 166. Manifold 166 simultaneously delivers control oil through lines 114 and 116 to chambers 165 and 173 of slave cylinders 162 and 160, respectively and through line 188, shuttle valve 177 and line 174 to chamber 161 of slave cylinder 164, and via line 192 to shuttle valve 176, line 118 to chamber 169 of slave cylinder 158 thus pressurizing all rod end chambers of slave cylinders 158, 160, 162, and 164 causing the piston rods to retract as previously described thereby moving spools 214 and 216 to the "out" position as shown in FIG. 12.

At the same time the opposite chamber of slave cylinders 158, 160, 162 and 164 are drained by various lines shown through manifold 168, line 144 to master control valve 150, thence through lines 146, 142 and 152 to tank 250.

Figure 13:
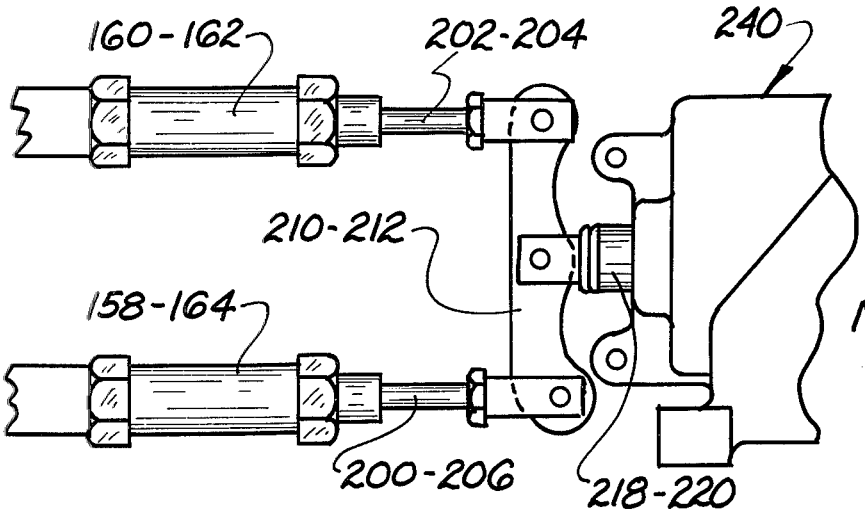

When master control operating handle 159 of master control valve 150 is actuated so that the spool is to the "in" position control flow is then reversed so that oil goes from line 148 through master control valve 150, line 144 to manifold 168. This pressurizes chambers 171, 175, 167 and 163 of slave cylinders 158, 160, 162, and 164, respectively. The opposite chambers are drained by the lines previously described and through manifold 166 and line 132, master control valve 150, line 146, 142, 152 to tank 250. Pressurization of these chambers extends piston rods 202, 200, 204 and 206 thus shifting spools 214 and 216 to the "IN" position as shown in FIG. 13.

FIG. 8-A diagrammatically illustrates the flow action of shuttle valves 176, 172, 175 and 177. Using shuttle valve 176 as an example, pressurized oil entering from line 192 will shift ball check 119 so that oil cannot enter line from 170. Pressure oil will be diverted to line 118. This is as shown in Position 1.

FIG. 8-B shows the shuttle valve 176 with reverse flow wherein pressurized oil flowing from 170 shifts ball check 119 so that oil is prevented from going out line 192 with the oil being diverted to line 118. It should now be understood that shuttle valves 176, 172, 175, and 177 permit the operation of salve cylinders 158 through 164 by pressurized oil coming from either of two different sources; that is, either a service source from manifold 166 or 168 or an emergency source from manifold 170.

EMERGENCY ACTUATION OF THE CONTROL FLOW CIRCUIT

The control flow circuit incorporates an emergency stop valve 122 which is a four-way, two position control valve. Valve 122 is detented in either the "in" or the "out" position only and is manually actuated by an emergency actuator 124. As has been previously described, actuator 124 must be in the "out" position so that control oil passes through emergency stop valve 122 and into line 126 for normal operation of the control flow circuit.

Figure 11:
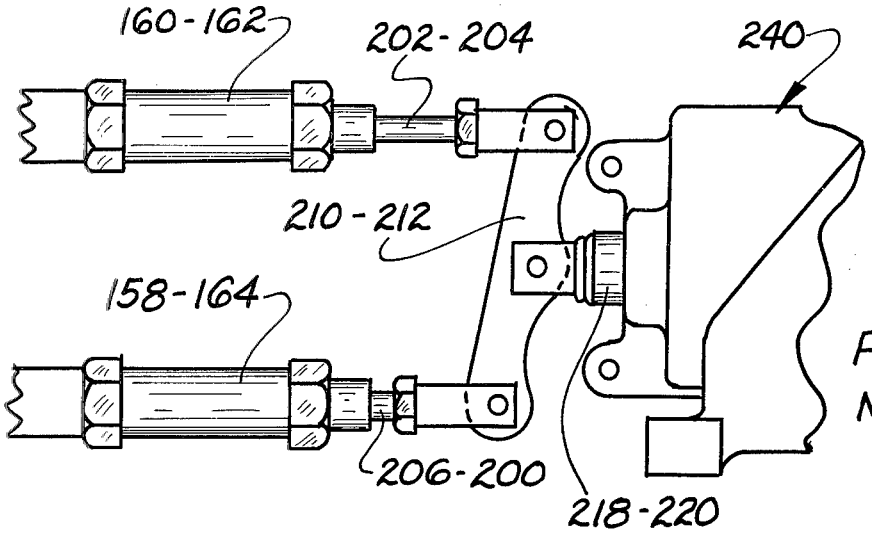
FIGS. 11 through 13 are partial side elevational views of a rocker arm apparatus comprising a portion of the control apparatus of FIG. 7.

The basic purpose of emergency stop valve 122 is to completely stop any packing action of the machine at any point during the cycle of operation. This is accomplished by manually pushing actuator 124 to the "in" position. With actuator 124 of emergency stop valve 122 in the "in" position the control oil flows from line 120 through emergency stop valve 122 and via lines 128 to manifold 170. Control oil from manifold 170 goes through shuttle valve 176 and line 118 to chamber 169 of slave cylinder 158. Also, control oil from manifold 170 passes through shuttle valve 172, line 182 into chamber 175 of slave cylinder 160. As may be noted, this retracts the piston rod 200 of slave cylinder 158 and extends piston rod 202 of slave cylinder 160. The immediate effect of this action is to forcibly return spool 216 of power flow control valve 240 to the neutral position as shown in FIG. 11. In like manner, emergency control oil from manifold 170 is supplied to slave cylinder 162 and 164 extending piston rod 204 and retracting piston rod 206. This again forcibly returns spool 214 of power flow control valve 240 to the neutral position of FIG. 11.

It will now be seen that blade actuating cylinder 52 and packing cylinders 40 are instantly and forcibly isolated and hence any motion of blade 50 and carriage 68 is instantly stopped regardless of position. Reactivation of the packing mechanism is impossible until actuator 124 of emergency stop valve 122 has been manually returned to the "out" position.

As seen in FIG. 8 the control flow circuit is preferably provided with a gauge port 106 for the attachment of a pressure gauge for the control flow. It will be understood that through use of the flow divider 100 it is possible, though not necessary, to operate the entire control flow circuit of FIG. 8 at a pressure lower than the operating pressure of the power flow circuit of FIG. 7. This, of course, can be pre-set or controlled by a pressure relief valve 104 within the flow divider 100.

OPTIONAL HOLDING CIRCUIT

Figure 9:
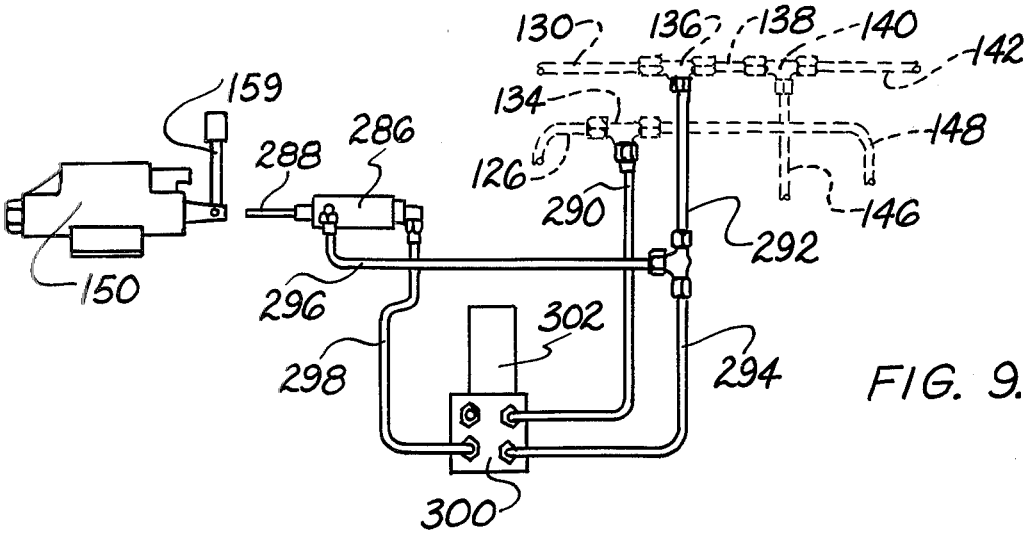
FIG. 9 is a third diagrammatic view of the control system for the refuse machine of the preceding figures.
Figure 10:
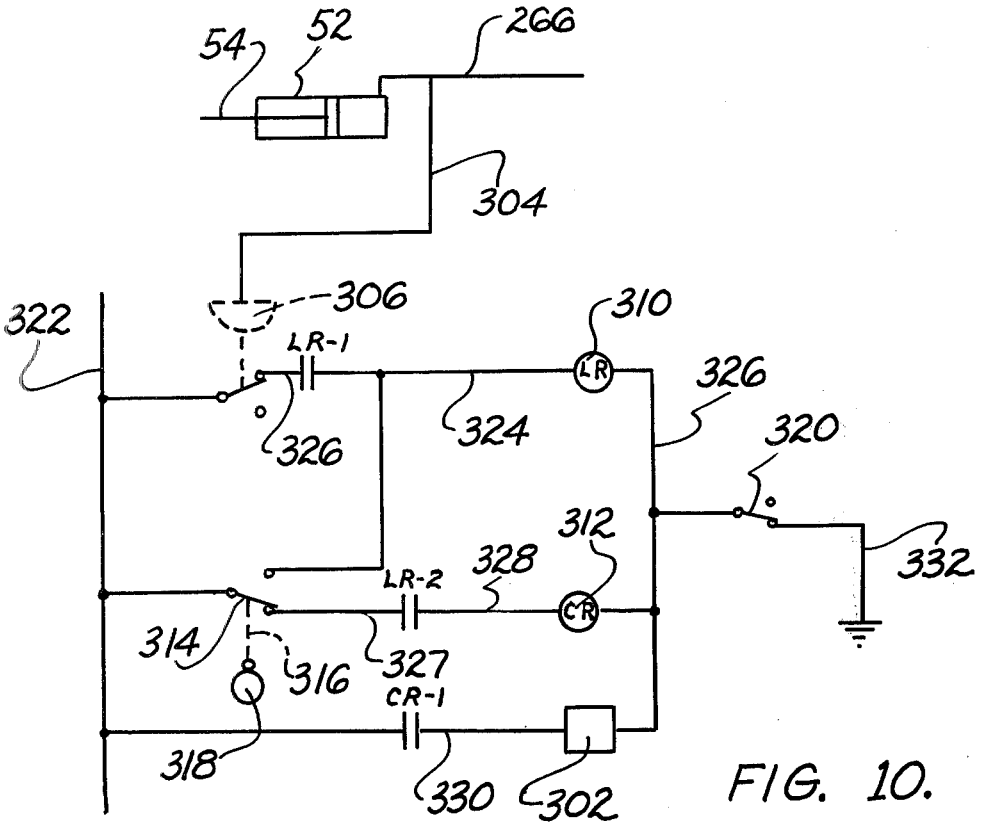
FIG. 10 is a fourth diagrammatic view of the control system of the refuse machine of the preceding figures.

It should be next mentioned that in certain types of operation it is desirable to speed up the packing operation. This is accomplished by an optional holding circuit for continuing automatic operation of the packer blade after it passes the pinch point which may be provided as shown in FIGS. 9 and 10. With reference to the previous description, when packing blade 50 pivots from Position 2 to Position 3, FIGS. 4 and 5, it was necessary for the operator to manually maintain pressure on master control operating handle 159 of master control valve 150.

In passing from Position 2 to 3 it will be noted that the tip of the packing blade 50 goes past a so-called "pinch point 35," FIGS. 4 and 5. In normal operation any time the operator releases his pressure on the master control handle 159 movement of the blade is instantaneously stopped as a safety factor. Moreover, spool 216 is immediately returned to neutral thus diverting oil to spool 214 which is, at that time, positioned to deliver oil to the base end of packing cylinder 40 whereby the carriage 68 and packing plate 50 mounted thereon are immediately moved up and away from the pinch point.

The above mentioned requirement for the operator to continually maintain pressure on the master control handle 159 can be overridden by an optional holding circuit which can easily be provided as illustrated in FIG. 9. It should be mentioned at the outset that such circuit is connected to the main control flow circuit of FIG. 8 at the "T" fittings 134 and 136 by attaching the lines 290 and 292 at such fittings.

FIG. 10 shows an electrical schematic circuit which may be used to control the hold-through circuit as shown in FIG. 9. Electrical power for this control circuit is supplied from the vehicle electrical system through lines 322 and 332.

As may be noted in FIG. 3, a limit switch 314 is mounted on carriage 68. A cam-type operator 318 is mounted on blade 50.

During packing cycle operation as blade 50 moves from Position 4 as shown in FIG. 6 to Position 1 as shown in FIG. 3 bracket 318 on the scoop actuates arm 316 of limit switch 314 thereby energizing the circuit consisting of lines 322, 324, 326, and 332 thus energizing relay coil 310. Energizing relay coil 310 will close contacts LR-1 and LR-2. A holding circuit is thus formed through lines 322, pressure switch 306, line 326, contact LR-1, line 324, 326 and 332, which maintains relay coil 310 in the actuated position. It must be noted that this also closes relay contact LR-2 until such time as pressure switch 306 deactivates relay coil 310.

Arm 316 of limit switch 314 has been previously set so that limit switch 314 will not close until such time as blade 50 moves from Position 2, FIG. 4, to Position 3, FIG. 5, wherein it is past pinch point 35. As such time as limit switch 314 again returns to its normal position a circuit will be complete from line 322 through limit switch 314, line 327, contact LR-2, line 328, 326 and 332, which will energize relay coil 312. Energization of relay coil 312 will close contact CR-1. This will in turn complete a circuit from line 322 through line contact CR-1, line 330, 326 and 332, to solenoid coil 302 of a hold-through valve 300.

Referring to FIG. 9 with solenoid 302 energized pressurized oil flows via line 290 through valve 300 to line 298 and into the base end of a hold-through cylinder 286. This action causes piston 288 of slave cylinder 286 to extend against the end of the spool of master control valve 150 thus holding this spool in the engaged position.

In the event the previously mentioned emergency stop valve 122, FIG. 8 is at any time actuated then a valve actuated limit switch 320, FIGS. 8 and 10 will immediately de-energize all relays in the hold-through circuit of FIG. 10 whereby the coil 302 of hold-through valve 300 is de-energized thereby terminating pressurization of hold-through cylinder 286 with the immediate result that power flow control valve 240 is returned to its neutral position. Hence the packing mechanism is immediately brought to an emergency stop.

While the forms of embodiments of the present invention as herein disclosed constitute preferred forms, it is to be understood that other forms might be adopted.

What is claimed is:

1. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions; a signal flow fluid circuit including a signal flow control valve means for controlling a signal flow of fluid; fluid actuated operator means in said signal flow fluid circuit for operating said power flow control valve means; a manual controller for said signal flow control valve means, said power flow control valve means including a first spool for controlling said blade actuating fluid motor and a second spool for controlling said packing fluid motor; a first rocker bar including a central pivot connected to said first spool, and first and second end pivots; a second rocker bar including a central pivot connected said second spool, and first and second end pivots; said fluid actuated operator means including first and second slave cylinders connected to said first and second end pivots of said first rocker bar; and third and fourth slave cylinders connected to said first and second end pivots of said second rocker arm.

2. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions; a signal flow fluid circuit including a signal flow control valve means for controlling a signal flow of fluid; fluid actuated operator means in said signal flow fluid circuit for operating said power flow control valve means; a manual controller for said signal flow control valve means, said signal flow fluid circuit including an emergency stop valve for delivering an emergency signal flow to said fluid actuated operator means to return said power flow control valve means to said "neutral" position.

3. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions; a signal flow fluid circuit including a signal flow control valve means for controlling a signal flow of fluid; fluid actuated operator means in said signal flow fluid circuit for operating said power flow control valve means; a manual controller for said signal flow control valve means, said fluid actuated operator means including service chamber means and emergency chamber means; said signal flow fluid circuit including an emergency stop valve delivering an emergency signal flow to said fluid actuated operator means to return said power flow control valve means to said "neutral" position; and shuttle valve means for delivering signal flow fluid to said service chamber means upon actuation of said manual controller and for delivering signal flow fluid to said emergency chamber means upon actuation of said emergency stop valve.

4. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions; a signal flow fluid circuit including a signal flow control valve means for controlling a signal flow of fluid; fluid actuated operator means in said signal flow fluid circuit for operating said power flow control valve means; a manual controller for said signal flow control valve means, said signal flow fluid circuit including a pressure actuated hold-through cylinder for biasing said signal flow control valve means in an actuated position during a certain position of the cycle of the packer blade; a hold-through valve for controlling the flow of fluid to said hold-through cylinder; and means for shifting said hold-through valve between open and closed positions.

5. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions; a signal flow fluid circuit including a signal flow control valve means for controlling a signal flow of fluid; fluid actuated operator means in said signal flow fluid circuit for operating said power flow control valve means; a manual controller for said signal flow control valve means, said signal flow fluid circuit including an emergency stop valve for delivering an emergency signal flow to said fluid actuated operator means to return said power flow control valve means to said "neutral" position; said signal flow fluid circuit including a pressure actuated hold-through cylinder for biasing said signal flow control valve means in an actuated position during a certain portion of the cycle of the packer blade; a hold-through valve for controlling the flow of fluid to said hold-through cylinder; and means for shifting said hold through valve between open and closed positions responsive to actuation of said emergency stop valve.

6. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions, said power flow control valve means includes a first spool for controlling said blade actuating fluid motor and a second spool for controlling said packing fluid motor; a signal flow fluid circuit including a signal flow control valve means for controlling a signal flow of fluid; fluid actuated operator means in said signal flow fluid circuit for operating said power flow control valve means, said fluid actuated operator means including a first slave cylinder means operatively connected to said first spool and a second slave cylinder means operatively connected to said second spool; a manual controller for said signal flow control valve means, said fluid actuated operator means including service chamber means and emergency chamber means; said signal flow fluid circuit including an emergency stop valve for delivering an emergency signal flow to said fluid actuated operator means to return said power flow control valve means to said "neutral" position; and shuttle valve means for delivering signal flow fluid to said service chamber means upon actuation of said manual controller and for delivering signal flow fluid to said emergency chamber means upon actuation of said emergency stop valve.

7. A rear loader type refuse truck comprising, in combination, a body including a forward refuse receiving body portion and a rear packer body portion, said rear packer body portion including a load receiving opening; a packer blade means forwardly of said load receiving opening and including mounting means for longitudinal and pivotal movement of said packer blade; a blade actuating fluid motor operatively connected to said packer blade; a load packing fluid motor operatively connected to said mounting means for compacting the load; a power flow fluid circuit including a power flow control valve means for controlling the flow to said fluid motors, said valve means including a "neutral" position and a plurality of fluid motor actuating positions, said power flow control valve means includes a first spool for controlling said blade actuating fluid motor and a second spool for controlling said packing fluid motor; a signal flow fluid circuit including a signal flow control valve means for controlling a signal flow of fluid; fluid actuated operator means in said signal flow fluid circuit for operating said power flow control valve means, said fluid actuated operator means including a first slave cylinder means operatively connected to said first spool and a second slave cylinder means operatively connected to said second spool; a manual controller for said signal flow control valve means, said signal flow fluid circuit including a pressure actuated hold-through cylinder for biasing said signal flow control valve means in an actuated position during a certain portion of the cycle of the packer blade; a hold-through valve for controlling the flow of fluid to said hold-through cylinder; and means for shifting said hold-through valve between open and closed positions.

* * * * *